US012250986B2

(12) United States Patent
Stauffer

(10) Patent No.: US 12,250,986 B2
(45) Date of Patent: Mar. 18, 2025

(54) ARTICLE OF FOOTWEAR

(71) Applicant: NIKE, Inc., Beaverton, OR (US)

(72) Inventor: Morgan Stauffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 72 days.

(21) Appl. No.: 18/173,922

(22) Filed: Feb. 24, 2023

(65) Prior Publication Data

US 2023/0270207 A1 Aug. 31, 2023

Related U.S. Application Data

(60) Provisional application No. 63/313,990, filed on Feb. 25, 2022.

(51) Int. Cl.

| | |
|---|---|
| ***A43B 13/12*** | (2006.01) |
| ***A43B 13/16*** | (2006.01) |
| ***A43B 13/18*** | (2006.01) |
| ***A43B 13/37*** | (2006.01) |
| ***A43B 13/41*** | (2006.01) |

(52) U.S. Cl.

CPC ..... *A43B 13/12* (2013.01); *A43B 13/16* (2013.01); *A43B 13/186* (2013.01); *A43B 13/37* (2013.01); *A43B 13/41* (2013.01)

(58) Field of Classification Search

CPC ..... A43B 13/10; A43B 13/12; A43B 13/41; A43B 13/42; A43B 13/127; A43B 13/183; A43B 13/185; A43B 13/186; A43B 13/188; A43B 13/189

See application file for complete search history.

(56) References Cited

U.S. PATENT DOCUMENTS

| | | | | | |
|---|---|---|---|---|---|
| 4,391,048 | A * | 7/1983 | Lutz | A43B 21/26 | 36/35 R |
| 5,077,915 | A * | 1/1992 | Gross | A43B 13/12 | 36/31 |
| 5,155,927 | A * | 10/1992 | Bates | A43B 13/189 | 36/114 |
| 5,179,791 | A * | 1/1993 | Lain | A43B 13/41 | 36/43 |

(Continued)

FOREIGN PATENT DOCUMENTS

| | | | | |
|---|---|---|---|---|
| EP | 1002473 A1 * | 5/2000 | ..... | A43B 13/026 |
| WO | WO-2007069069 A2 * | 6/2007 | ..... | A43B 13/026 |

*Primary Examiner* — Megan E Lynch

(74) *Attorney, Agent, or Firm* — Honigman LLP; Matthew H. Szalach; Jonathan P. O'Brien

(57) ABSTRACT

A sole structure includes a first cushioning element having a first top side and a bottom side formed on an opposite side from the first top side and defining a receptacle. The sole structure further includes a second cushioning element attached to the first cushioning element and having a second top side flush with the first top side of the first cushioning element. An upper plate is disposed within the receptacle and including a first end attached to the first cushioning element and a second end attached to the second cushioning element. A lower plate spaced is apart from the upper plate and includes a third end attached to the first cushioning element and a fourth end attached to the second cushioning element. A cushioning arrangement is disposed within the receptacle of the first cushioning element and attached to each of the upper plate and the lower plate.

20 Claims, 10 Drawing Sheets

(56) References Cited

U.S. PATENT DOCUMENTS 5,396,675 A * 3/1995 Vincent ..... B29D 35/122 36/114
5,987,782 A * 11/1999 Bramani ..... A43B 13/10 36/31
6,158,149 A * 12/2000 Rudy ..... A43B 13/206 36/71
6,389,713 B1 * 5/2002 Kita ..... A43B 13/18 36/31
8,584,377 B2 * 11/2013 Blevens ..... A43B 1/0072 36/114
9,332,805 B2 * 5/2016 Baum ..... A43B 13/37
9,968,160 B2 * 5/2018 Peyton ..... A43B 13/183
10,945,489 B2 * 3/2021 Conrad ..... A43B 13/186
11,622,602 B2 * 4/2023 Redon ..... A43B 13/183 36/28
2003/0000108 A1 * 1/2003 Kita ..... A43B 13/12 36/28
2003/0000109 A1 * 1/2003 Kita ..... A43B 13/188 36/31
2003/0093920 A1 * 5/2003 Greene ..... A43B 7/141 36/144
2003/0172548 A1 * 9/2003 Fuerst ..... A43B 13/026 36/28
2004/0049946 A1 * 3/2004 Lucas ..... A43B 1/0009 36/28
2005/0022425 A1 * 2/2005 Brown ..... B29D 35/122 36/25 R
2005/0102858 A1 * 5/2005 Yen ..... A43B 7/144 36/27
2005/0126039 A1 * 6/2005 LeVert ..... A43B 13/183 36/27
2005/0268490 A1 * 12/2005 Foxen ..... A43B 7/1445 36/28
2006/0283045 A1 * 12/2006 Kita ..... A43B 13/12 36/28
2007/0277401 A1 * 12/2007 Young-Chul ..... A43B 13/186 36/28
2008/0189982 A1 * 8/2008 Krafsur ..... A43B 7/1435 36/43
2008/0289220 A1 * 11/2008 Rivas ..... A43B 13/141 36/35 R
2009/0100705 A1 * 4/2009 Cook ..... A43B 13/12 36/28
2011/0167678 A1 * 7/2011 Peikert ..... A43B 7/08 36/3 R
2012/0174432 A1 * 7/2012 Peyton ..... A43B 13/188 36/31
2013/0227858 A1 * 9/2013 James ..... A43B 13/186 36/88
2014/0075779 A1 * 3/2014 Bruce ..... A43B 7/148 36/29
2016/0120263 A1 * 5/2016 Cortez ..... A43B 13/20 36/29
2017/0042286 A1 * 2/2017 Meschter ..... A43B 13/04
2018/0035751 A1 * 2/2018 Rehagen ..... A43B 13/181
2019/0387837 A1 * 12/2019 Luh ..... A43B 13/026
2021/0030112 A1 * 2/2021 Amoako ..... A43B 13/20
2021/0093039 A1 * 4/2021 Paterson ..... A43B 13/181
2021/0212892 A1 * 7/2021 Seo ..... A43B 7/146
2022/0192315 A1 * 6/2022 Coupe ..... A43B 13/188
2022/0194039 A1 * 6/2022 Jung ..... A43D 3/02
2022/0248800 A1 * 8/2022 Lambertz ..... A43B 7/1464

* cited by examiner

ARTICLE OF FOOTWEAR

CROSS REFERENCE TO RELATED APPLICATION

This application claims priority under 35 U.S.C. § 119(e) to U.S. Provisional Application No. 63/313,990, filed on Feb. 25, 2022. The disclosure of this prior application is considered part of the disclosure of this application and is hereby incorporated by reference in its entirety.

FIELD

The present disclosure relates generally to sole structures for articles of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole and/or a sockliner located within a void proximate to the bottom portion of the upper.

High-intensity interval training (HITT) workouts alternate bouts of going all-out with periods of rest to recover. The movements are diverse—burpees, kettlebell swings, lunges, mountain climbers, push-ups, squats and many more— and are sequenced to get maximum impact from maximum effort. In HIIT workout classes, athletes typically wear footwear that is optimized for cushioning or footwear that is optimized for support. Unfortunately, such footwear, while adequate for its intended purpose (i.e., cushioning or support), isn't designed to concurrently provide both benefits and, as a result, do not perform optimally during HIIT movements.

BRIEF DESCRIPTION OF DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
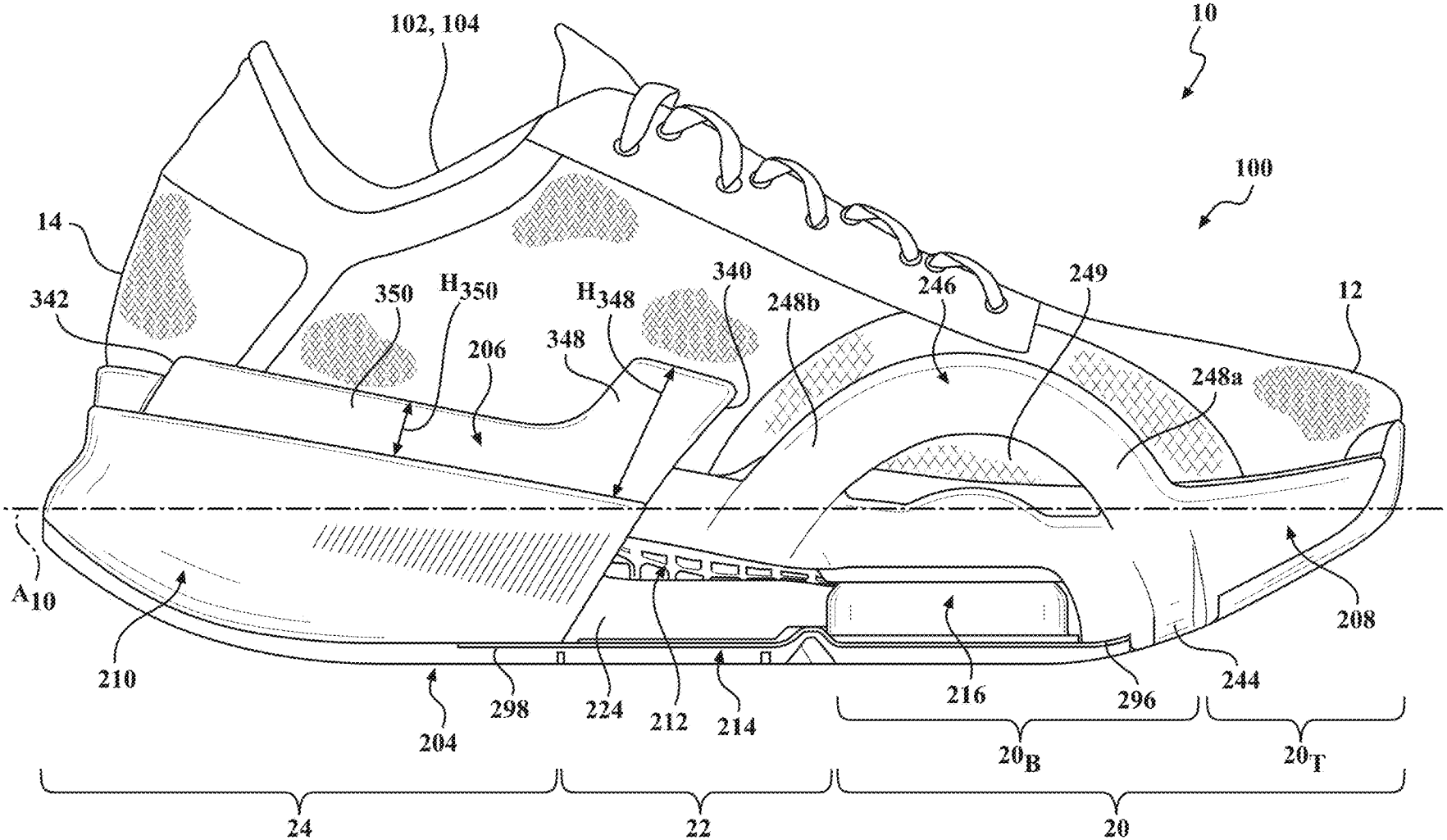
FIG. 1 is a lateral side elevation view of an article of footwear according to the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 7:
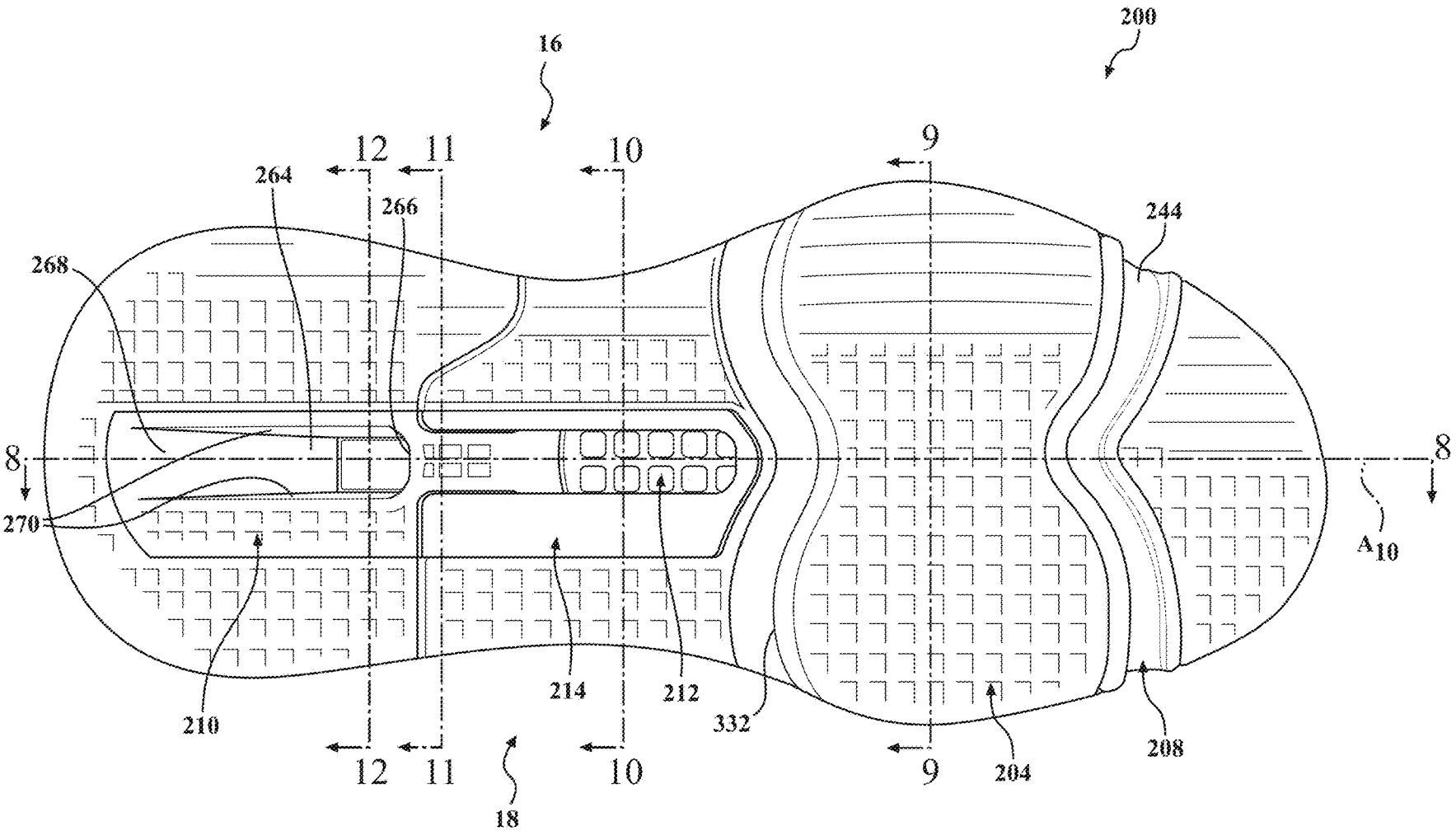
FIG. 7 is a bottom plan view of the article of footwear of FIG. 1.
Figure 8:
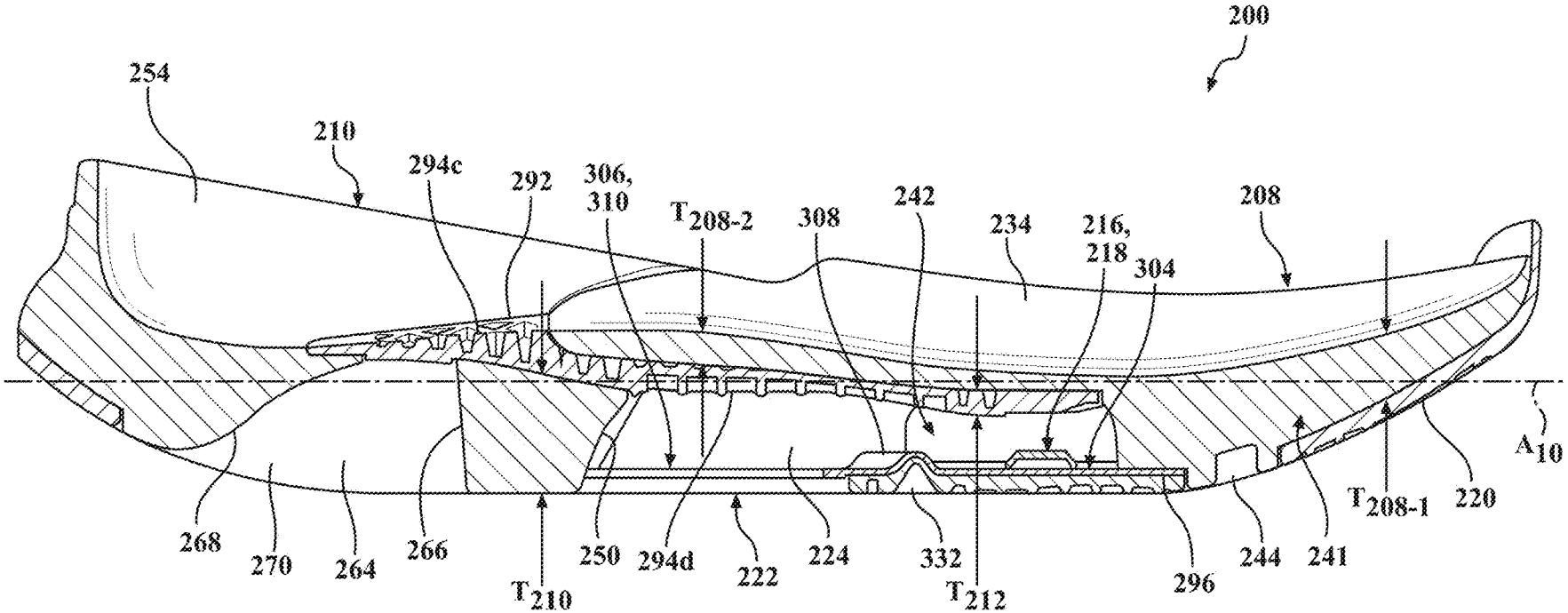
FIG. 8 is a cross-sectional view of the article of footwear of FIG. 1, taken along section line 8-8 of FIG. 7.
Figure 9:
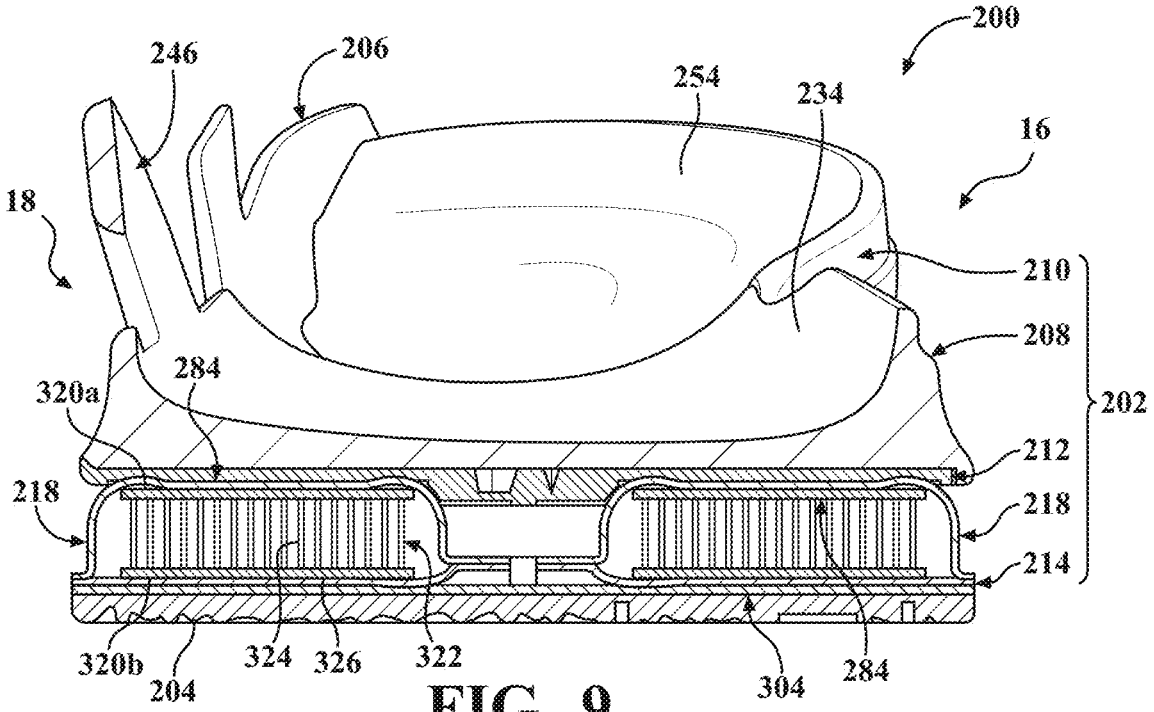
FIG. 9 is a cross-sectional view of the article of footwear of FIG. 1, taken along section line 9-9 of FIG. 7.

Referring to FIG. 1, an article of footwear 10 includes an upper 100 and sole structure 200. The footwear 10 may further include an anterior end 12 associated with a forward-most point of the footwear 10, and a posterior end 14 corresponding to a rearward-most point of the footwear 10. As shown in FIGS. 7 and 8, a longitudinal axis Aio of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may be subdivided into a toe portion $\mathbf{20}_T$ corresponding with phalanges and a ball portion $\mathbf{20}_B$ associated with metatarsal bones of a foot. The mid-foot region 22 may correspond with an arch area of the foot, and the heel region 24 may correspond with rear portions of the foot, including a calcaneus bone.

The upper 100 includes interior surfaces that define an interior void 102 configured to receive and secure a foot for support on the sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort. In some examples, the upper 100 includes a strobel having a bottom surface opposing the sole structure 200 and an opposing top surface defining a footbed of the interior void 102. Stitching or adhesives may secure the strobel to the upper 100. The footbed may be contoured to conform to a profile of the bottom surface (e.g., plantar) of the foot. Optionally, the upper 100 may also incorporate additional layers such as an insole or sockliner that may be disposed upon the strobel and reside within the interior void 102 of the upper 100 to receive a plantar surface of the foot to enhance the comfort of the article of footwear 10. An ankle opening 104 in the heel region 24 may provide access to the interior void 102. For example, the ankle opening 104 may receive a foot to secure the foot within the void 102 and to facilitate entry and removal of the foot from and to the interior void 102. In some examples, one or more fasteners extend along the upper 100 to adjust a fit of the interior void 102 around the foot and to accommodate entry and removal of the foot therefrom.

Figure 2:
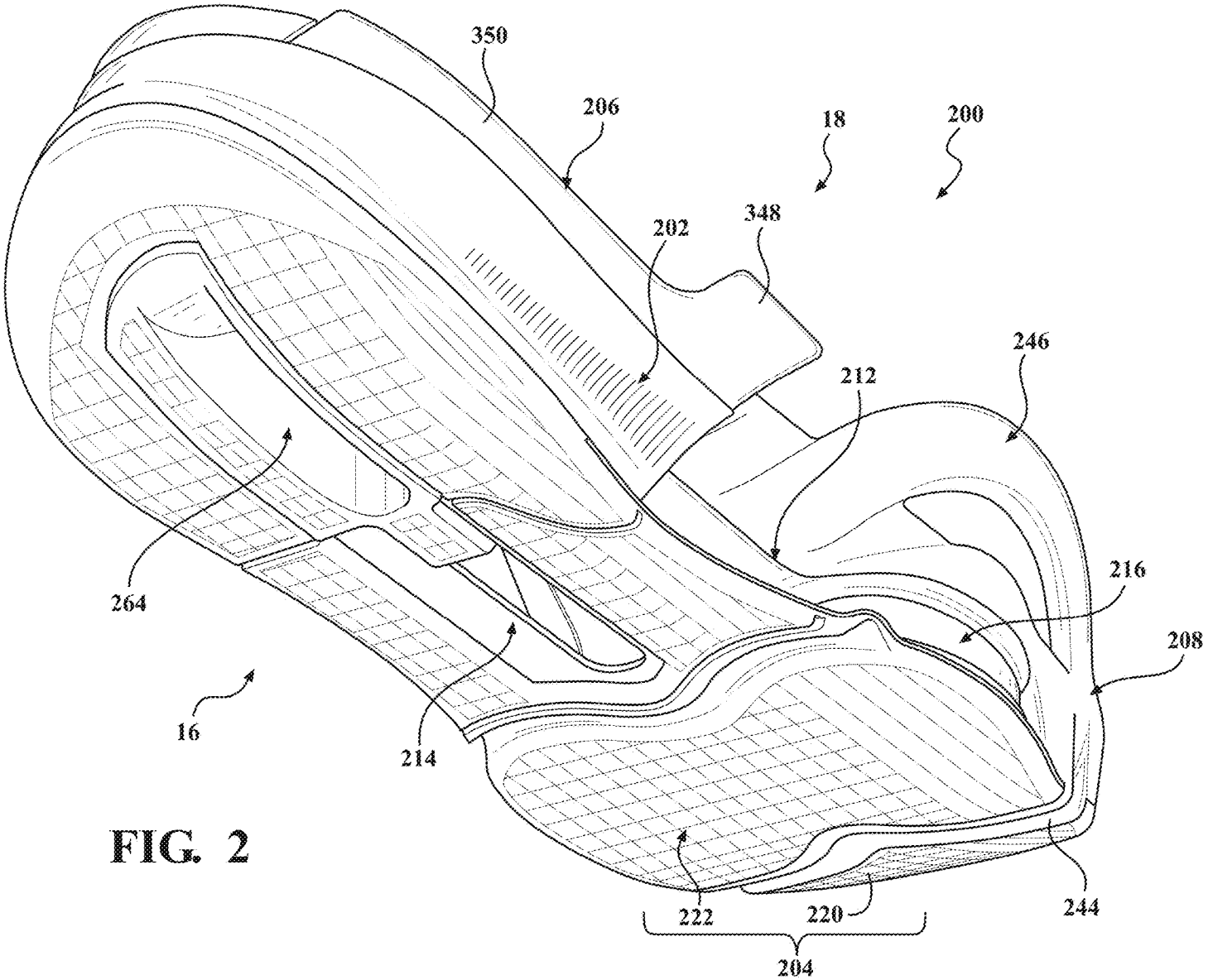
FIG. 2 is a lateral side perspective view of a sole structure of the article of footwear of FIG. 1.
Figure 3:
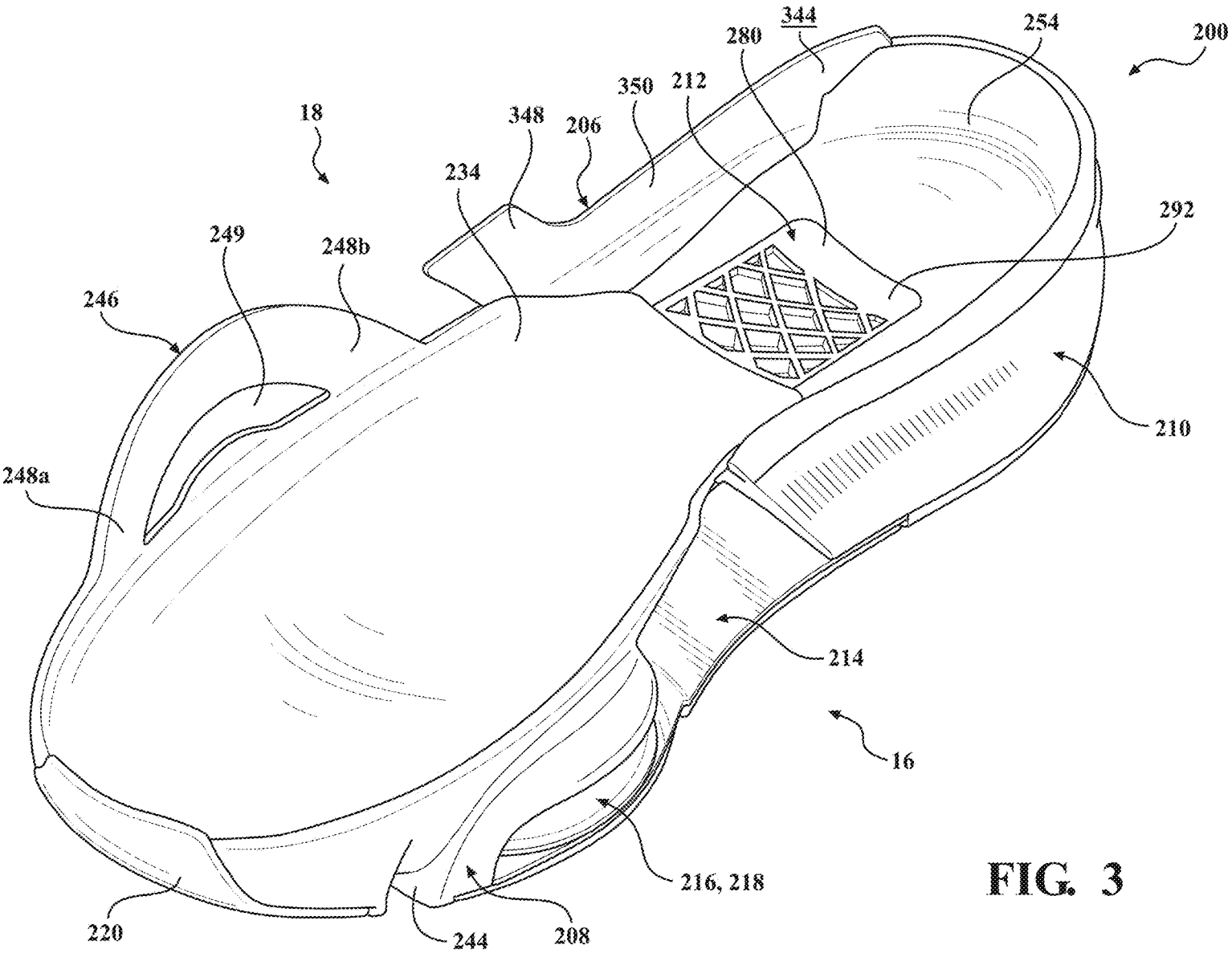
FIG. 3 is a medial side perspective view of a sole structure of the article of footwear of FIG. 1.

Referring to FIGS. 1-3, the sole structure 200 includes a midsole 202 configured to provide characteristics of cushioning and responsiveness, an outsole 204 configured to provide a ground-engaging surface to the article of footwear 10, and a lateral support member 206 attached to the midsole 202 and configured to provide lateral stability along a lateral side 18 of the upper 100. Unlike conventional midsoles formed of a single slab material, the midsole 202 of the present example is formed as a composite structure and includes various subcomponents configured to impart desired characteristics to the article of footwear 10. For example, the midsole 202 includes a forefoot cushioning element 208, a heel cushioning element 210, one or more plates 212, 214 each attached to the forefoot cushioning element 208 and the heel cushioning element 210, and a cushion or cushioning arrangement 216 having one or more fluid-filled bladders 218. While the cushion or cushioning arrangement 216 is described and shown as including one or more fluid-filled bladders 218, the cushion or cushioning arrangement 216 could alternatively include one or more cushions formed from foam. For example, one or both of the fluid-filled bladders 218 could be replaced with a cushion formed from foam and having the same size and shape as the fluid-filled bladder(s) 218. Alternatively, one or both of the fluid-filled bladders 218 could contain a cushion formed from foam such that the foam cushion is disposed within an inner void defined by the bladders 218. In this configuration, the fluid-filled bladder(s) 218 could receive a pressurized fluid in addition to the foam cushion or could receive the foam cushion and be at atmospheric pressure.

Regardless of the configuration of the cushion or cushioning arrangement 216, the one or more plates 212, 214 includes an upper plate 212 and a lower plate 214 spaced apart from the upper plate 212 by the cushioning arrangement 216. Like the midsole 202, the outsole 204 includes a fragmentary structure and includes an anterior fragment 220 attached to the forefoot cushioning element 208 at the anterior end 12 and a posterior fragment 222 attached to the lower plate 214 and the heel cushioning element 210.

Figure 4:
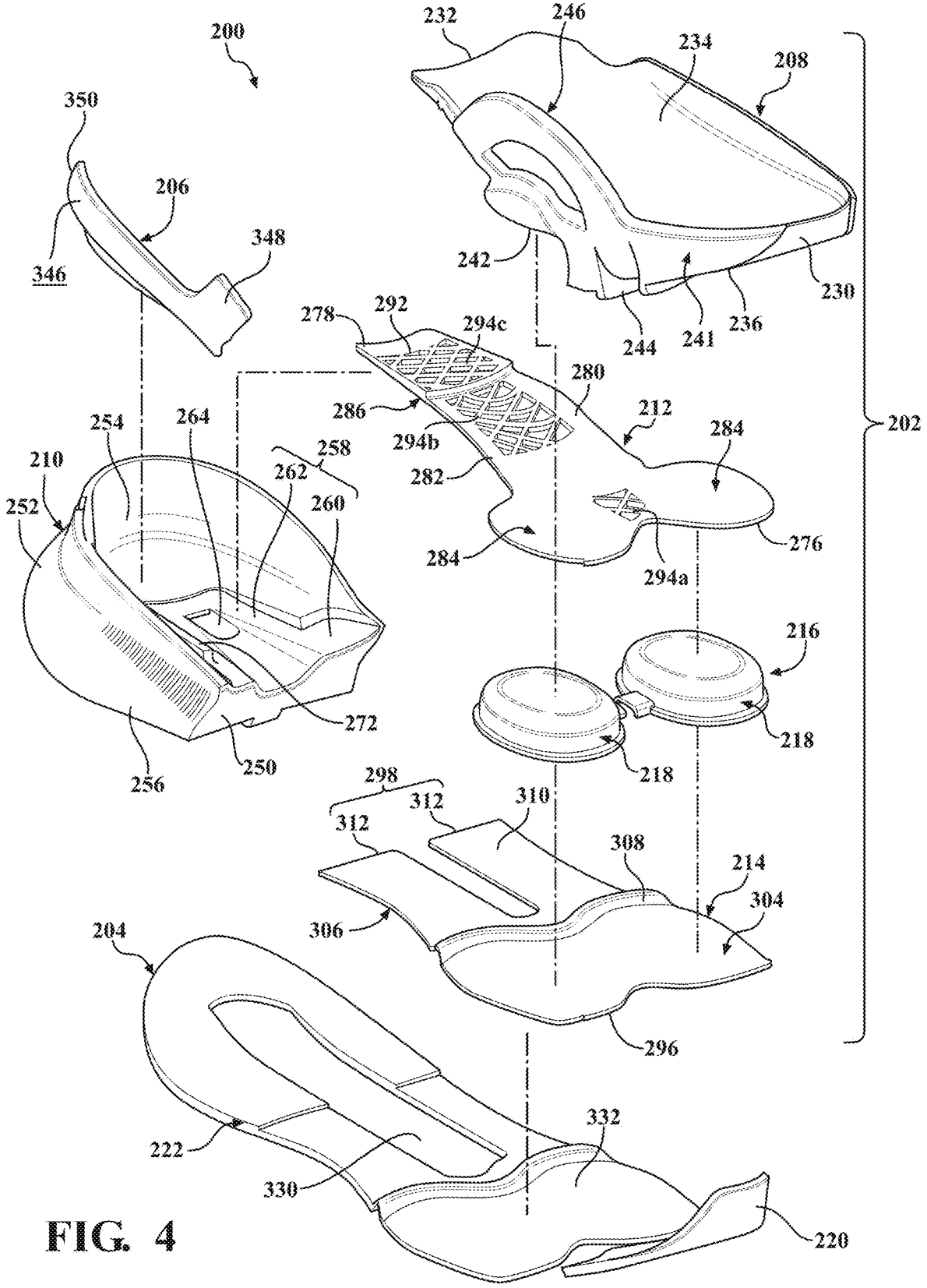
FIG. 4 is an exploded top-front-lateral perspective view of a sole structure of the article of footwear of FIG. 1.
Figure 5:
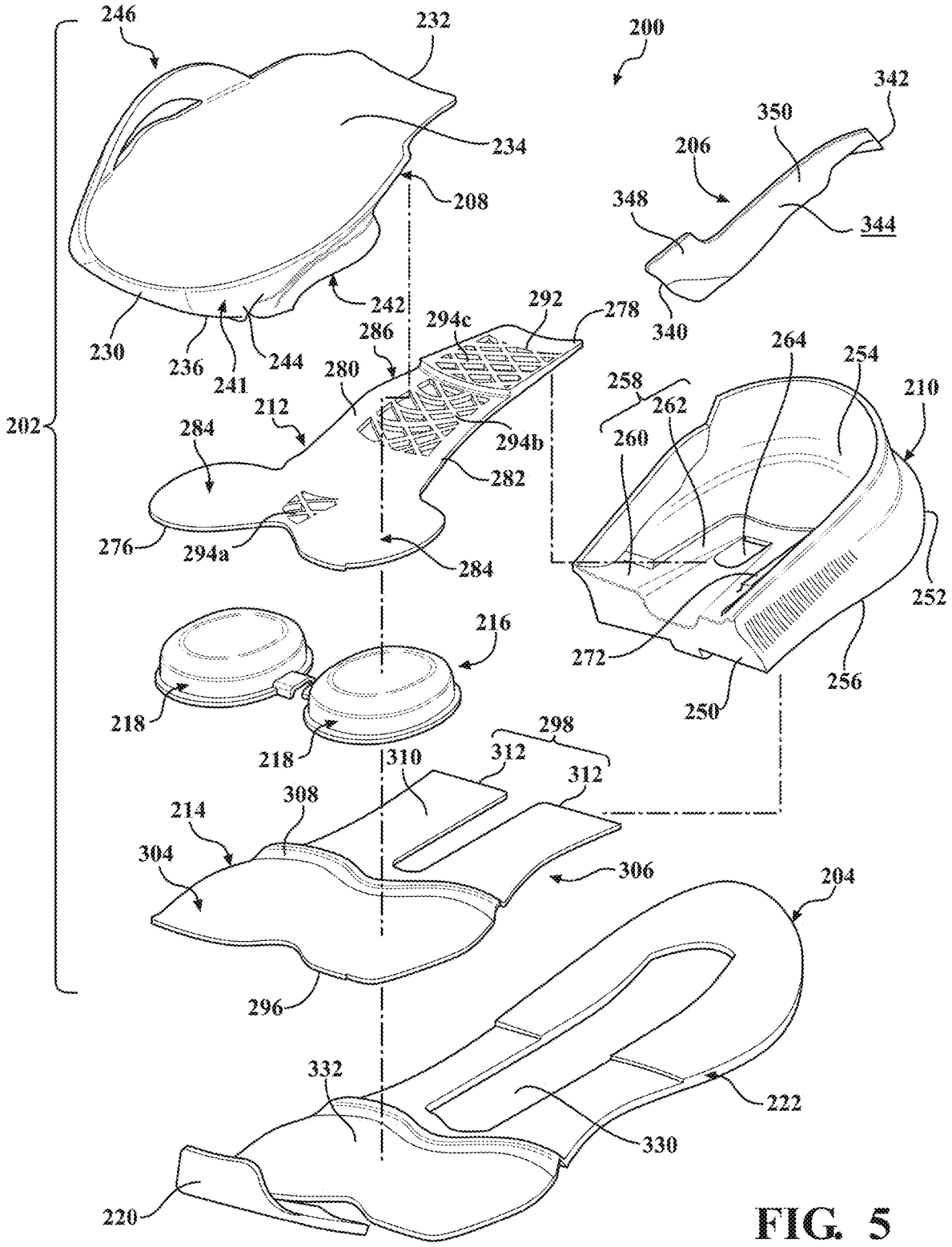
FIG. 5 is an exploded top-front-medial perspective view of a sole structure of the article of footwear of FIG. 1.
Figure 6:
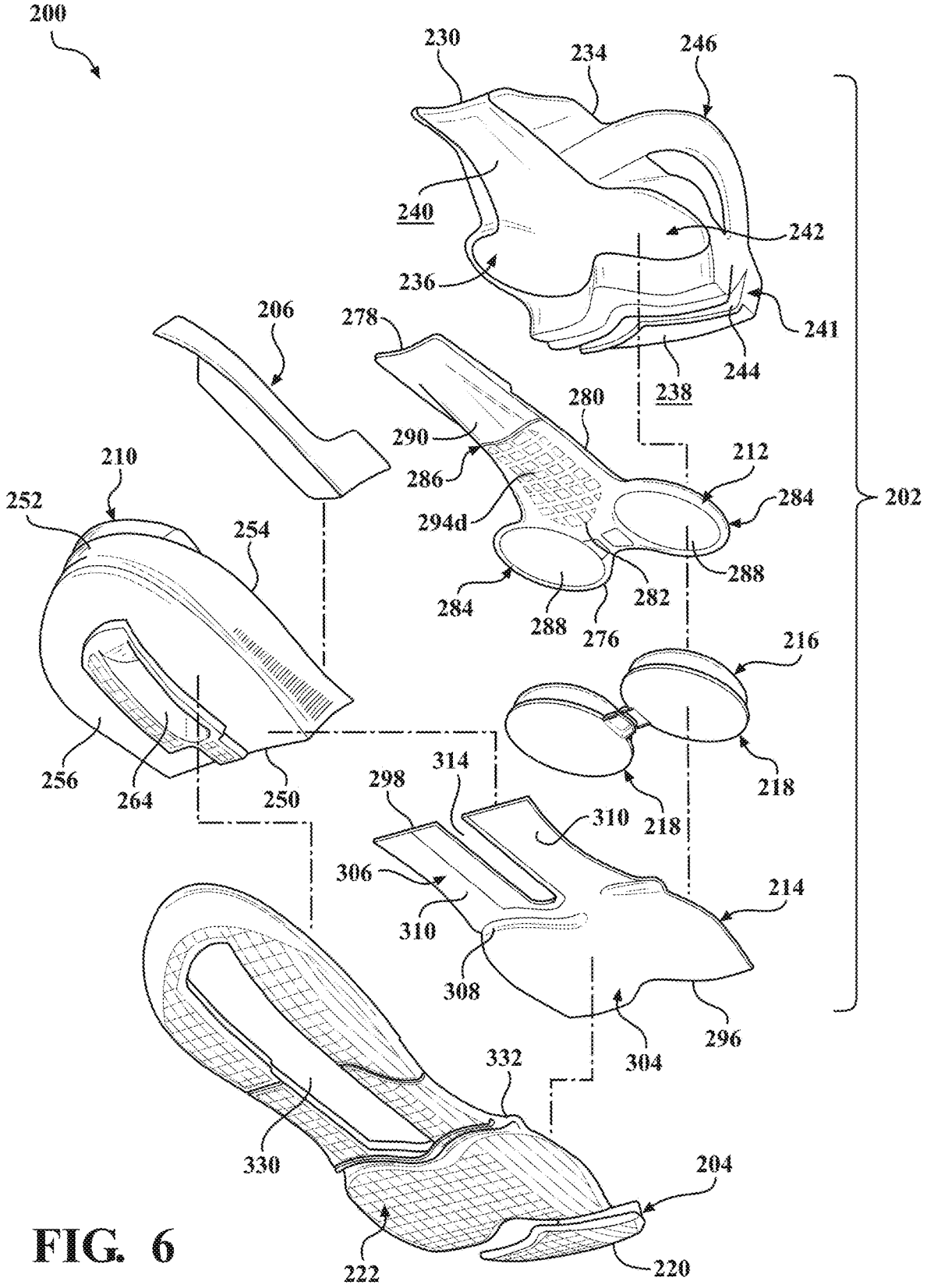
FIG. 6 is an exploded bottom-rear-lateral perspective view of a sole structure of the article of footwear of FIG. 1.

Referring to FIGS. 4-6, the forefoot cushioning element 208 extends from a first end 230 disposed at the anterior end 12 of the sole structure to a second end 232 in the mid-foot region 22 adjacent to the heel region 24. The forefoot cushioning element 208 includes a top surface or top side 234 defining a portion of a footbed of the sole structure 200 and configured to attach to the upper 100 (e.g., the strobel). A bottom side 236 of the forefoot cushioning element 208 is formed on the opposite side from the top side 234 and includes a first portion defined by a bottom surface 238 in the forefoot region 20 and a second portion defined by a lower surface 240 offset from the bottom surface 240 in the mid-foot region 22.

As best shown in FIG. 8, the first portion of the forefoot cushioning element 208 has a first thickness T208-1 from the top surface 234 to the bottom surface 238 in the forefoot region 20 and the second portion of the forefoot cushioning element 208 has a second thickness $T_{208\text{-}2}$ from the top surface 234 to the lower surface 240 in the mid-foot region 22. Accordingly, the first portion of the forefoot cushioning element 208 may be described as including a forefoot support element 241 along the toe portion 20T and a receptacle 242 extending along the mid-foot region 22. Particularly, the receptacle 242 is formed on the bottom side 236 of the forefoot cushioning element 208 where the lower surface 240 is offset from the bottom surface 238. As described in greater detail below, the upper plate 212 and the cushioning arrangement 216 are each at least partially received within the receptacle 242 of the forefoot cushioning element 208.

Referring to FIGS. 1-8, the forefoot cushioning element 208 further includes a plurality of features configured to tune the flexibility and stability of the sole structure 200 for HIIT-style exercises. For instance, the forefoot cushioning element 208 includes a flexure channel 244 extending along the bottom surface 238 from the medial side 16 to the lateral side 18 between the toe portion $20_T$ and the ball portion $20_B$. As shown in FIG. 8, the flexure channel 244 may include a rectangular cross-sectional profile extending from the medial side 16 to the lateral side 18. In FIG. 7, the flexure channel 244 extends along a path corresponding to a peripheral profile of an anterior end of the cushioning arrangement 216. For example, where the anterior end of the cushioning arrangement 216 includes a pair of convex surfaces, such as in the illustrated example, the flexure channel 244 is shown as extending along a path including a pair of arcuate segments complementing the profile of the anterior end of the cushioning arrangement 216.

With continued reference to FIG. 1, the forefoot cushioning element 208 may include a lateral stability member 246 extending from the top side 234 of the forefoot cushioning element 208. In the illustrated example, the lateral stability member 246 is formed as an integral part of the forefoot cushioning element 208 and defines an arcuate element extending from a first end 248*a* attached to the top side 234 of the forefoot cushioning element 208 between the toe portion $20_T$ and the ball portion $20_B$ to a second end 248*b* attached to the top side 234 of the forefoot cushioning element 208 in the mid-foot region 22. Accordingly, the lateral stability member 246 is aligned with a metatarsophalangeal (MTP) joint along the lateral side 18. Here, the arcuate lateral stability member 246 defines an arcuate opening 249 between the lateral stability member 246 and the top side 234 of the forefoot cushioning element.

Notably, the forefoot cushioning element 208 only includes the lateral stability member 246 on the lateral side 18 of the sole structure 200, while the top side 234 of the forefoot cushioning element 208 is substantially flush and continuous along the medial side 16. Thus the lateral stability member 246 is configured to provide lateral support (i.e., transverse to the longitudinal axis Aio) along the lateral side 18 of the upper 100 during traditional exercises associated with a HIIT workout, such as lateral squats or skater lunges. In addition to providing lateral support, the lateral stability member 246 may provide longitudinal stiffness along the lateral side of the sole structure 200 and the upper 100 to minimize flexing of the sole structure 200 along the ball portion 20B. As shown, the first end 248a of the lateral stability member 246 is attached to the top side 234 of the forefoot cushioning element 208 on an opposite side (i.e., the top side 234) from the flexure channel 244. Accordingly, the lateral stability member 246 and the flexure channel 244 may cooperate to provide increased flexibility between the toe portion $20_T$ and the ball portion $20_B$, while improving stability along the ball portion $20_B$.

The heel cushioning element 210 extends from a first end 250 adjacent to the mid-foot region 22 to a second end 252 at the posterior end 14 of the sole structure 200. The heel cushioning element 210 includes a top side 254 defining another portion of the footbed of the sole structure 200 and configured to attach to the upper 100. A bottom side 256 of the heel cushioning element 210 is formed on the opposite side from the top side 254. As best shown in FIG. 1, the first end 250 of the heel cushioning element 210 includes an end surface extending at an oblique angle relative to the longitudinal axis Aio from the top side 254 to the bottom side 256 such that the top side 254 of the heel cushioning element 210 extends closer to the anterior end 12 than the bottom side 256.

The top side 254 of the heel cushioning element 210 includes an upper socket 258 including an anterior portion 260 adjacent to the first end 250 and a posterior portion 262 extending from the anterior portion 260 between the first end 250 and the second end 252. As shown in FIGS. 3-5 and 10, the anterior portion 260 of the upper socket 258 is configured to receive each of the upper plate 212 and the second end 232 of the forefoot cushioning element 208 in a stacked configuration, whereby the upper plate 212 is disposed between the heel cushioning element 210 and the second end 232 of the forefoot cushioning element 208 in the upper socket 258 and the top side 234 of the forefoot cushioning element 208 is flush with the top side 254 of the heel cushioning element 210. The posterior portion 262 of the upper socket 258 extends from the anterior portion 260 and is configured to receive a second end of the upper plate 212 such that a top side of the upper plate 212 is flush with the top side 234 of the forefoot cushioning element 208 and the top side 254 of the heel cushioning element 210. Thus, the forefoot cushioning element 208, the heel cushioning element 210, and the upper plate 212 each define a portion of the footbed of the sole structure 200, as shown in FIG. 3.

Figure 12:
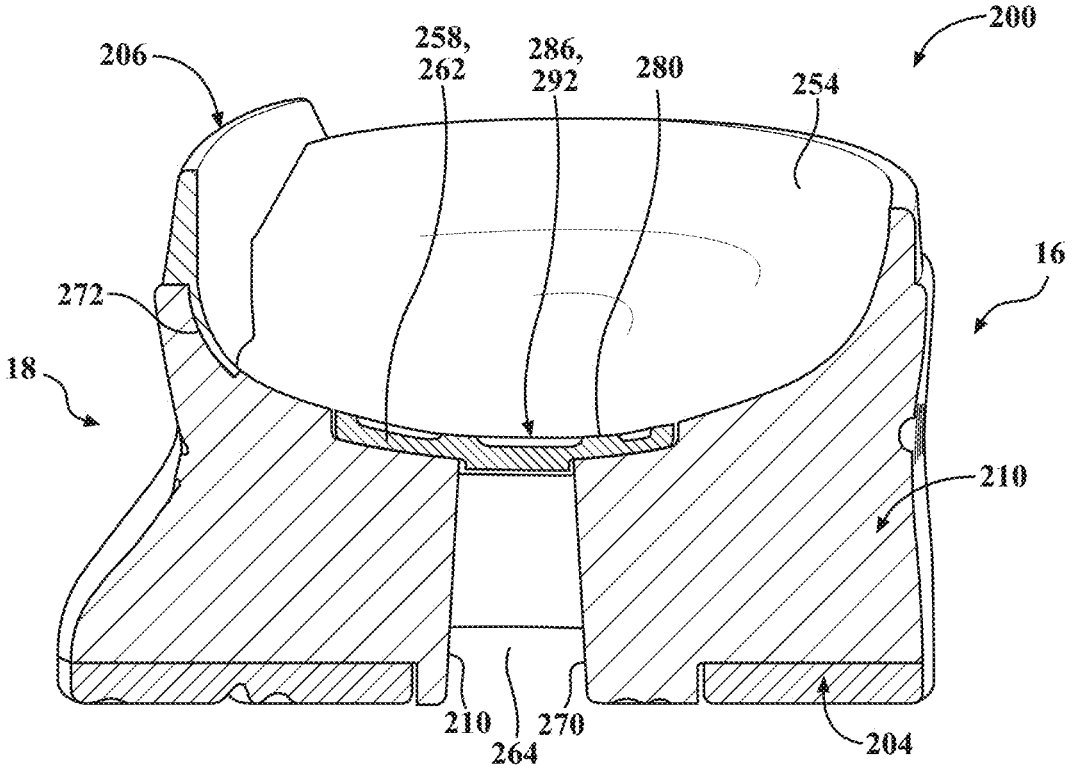
FIG. 12 is a cross-sectional view of the article of footwear of FIG. 1, taken along section line 12-12 of FIG. 7.

The heel cushioning element 210 further includes a passage 264 extending through a thickness $T_{210}$ of the heel cushioning element 210 from the top side 254 to the bottom side 256. As shown in FIG. 8, a length of the passage 264 extends from a substantially flat front wall 266 to a rear wall 268 having a compound contour along the direction from the top side 254 to the bottom side 256. Thus, the length of the passage 264 tapers along the direction from the bottom side 256 to the top side 254. With reference to FIG. 12, a width of the passage 264 extends between a pair of substantially flat sidewalls 270 and also tapers along the direction from the bottom side 256 to the top side 254.

Figure 11:
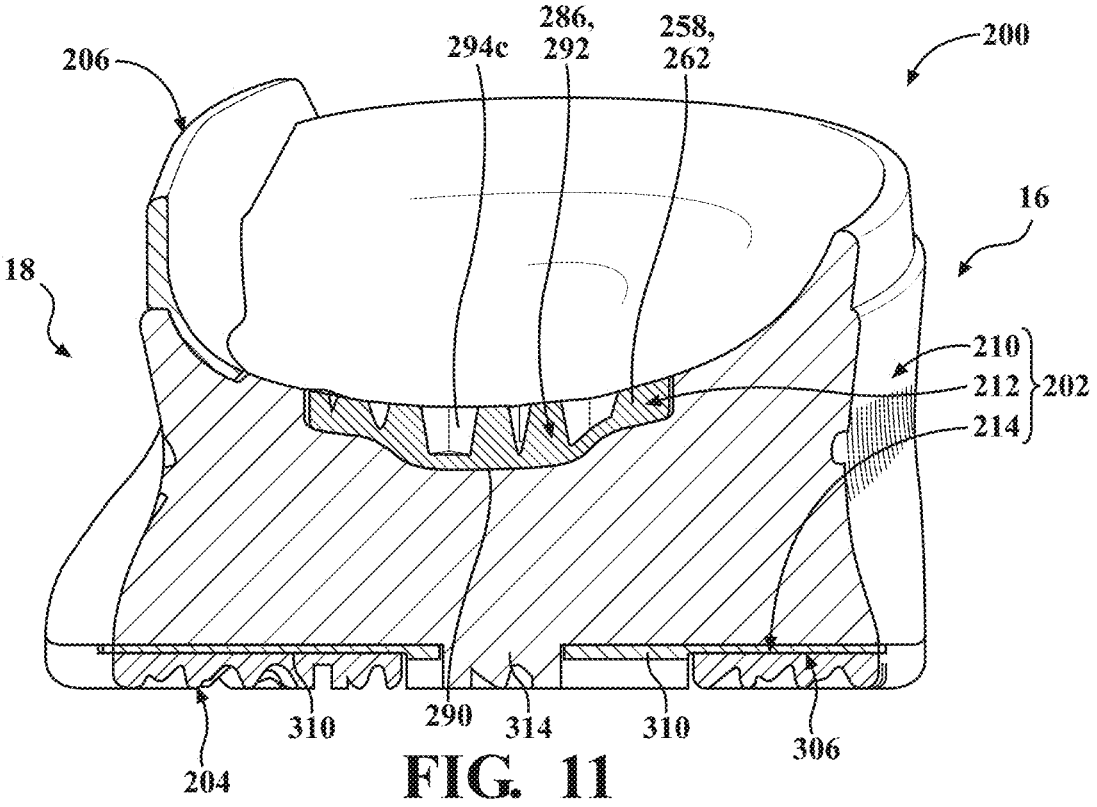
FIG. 11 is a cross-sectional view of the article of footwear of FIG. 1, taken along section line 11-11 of FIG. 7.

With reference to FIGS. 5, 11, and 12, the heel cushioning element 210 further includes a lateral support socket 272 formed in the top side 254 along the lateral side 18. As discussed in greater detail below, the lateral support socket 272 is configured to receive the lateral support member 206 such that an inner surface of the lateral support member 206 is flush with the top side 254 of the heel cushioning element 210 and forms another portion of the footbed.

The forefoot cushioning element 208 and the heel cushioning element 210 each include a resilient polymeric material, such as foam or rubber, to impart properties of cushioning, responsiveness, and energy distribution to the foot of the wearer. The forefoot cushioning element 208 and the heel cushioning element 210 may include the same or different materials to impart desired performance characteristics to the respective regions of the sole structure 200. Example resilient polymeric materials for the cushioning elements 208, 210 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Referring to FIGS. 4-6 and 8-12, the upper plate 212 extends from a first end 276 in the ball portion 20B to a second end 278 in the heel region 24. The upper plate 212 further includes a top side 280 configured to face the upper 100 and a bottom side 282 disposed on an opposite side of the upper plate 212 than the top side 280. A distance from the top side 280 to the bottom side 282 defines a thickness T212 of the upper plate 212. When the sole structure 200 is assembled, the top side 280 of the upper plate 212 mates with the lower surface 240 of the forefoot cushioning element 208 in the receptacle 242 and forms a portion of the footbed in the heel region 24. In other words, a first portion of the upper plate 212 is disposed on the bottom side 236 of the forefoot cushioning element 208 and a second portion of the upper plate 212 is flush with and exposed between the forefoot cushioning element 208 and the heel cushioning element 210. The upper plate 212 includes an elastomeric material, such as a polyether block amide (PEBA) (e.g., Pebax® brand elastomers manufactured by Arkema S.A).

The bottom side 282 of the upper plate 212 faces the cushioning arrangement 216 within the receptacle 242 at the first end 276 and mates with the upper socket 258 of the heel cushioning element 210 at the second end 278. As shown in FIGS. 1 and 8, an intermediate portion of the bottom side 282 of the upper plate 212 spans the gap 224 between the cushioning arrangement 216 and the first end 250 of the heel cushioning element 210. Here, the bottom side 282 of the upper plate 212 is spaced apart from the lower plate 214 by the gap 224 to provide a compression relief in the mid-foot region 22 of the sole structure 200.

With reference to FIGS. 4-6, the upper plate 212 includes a pair of lobes 284 disposed at the first end 276 and a shank 286 extending from the pair of the lobes 284 to the second end 278. Each of the lobes 284 defines a respective bladder socket 288 on the bottom side 282 for interfacing with one of the bladders 218 of the cushioning arrangement 216.

Here, each bladder socket 288 may be formed as a slight recess configured to receive a top side one of the bladders 218.

Figure 10:
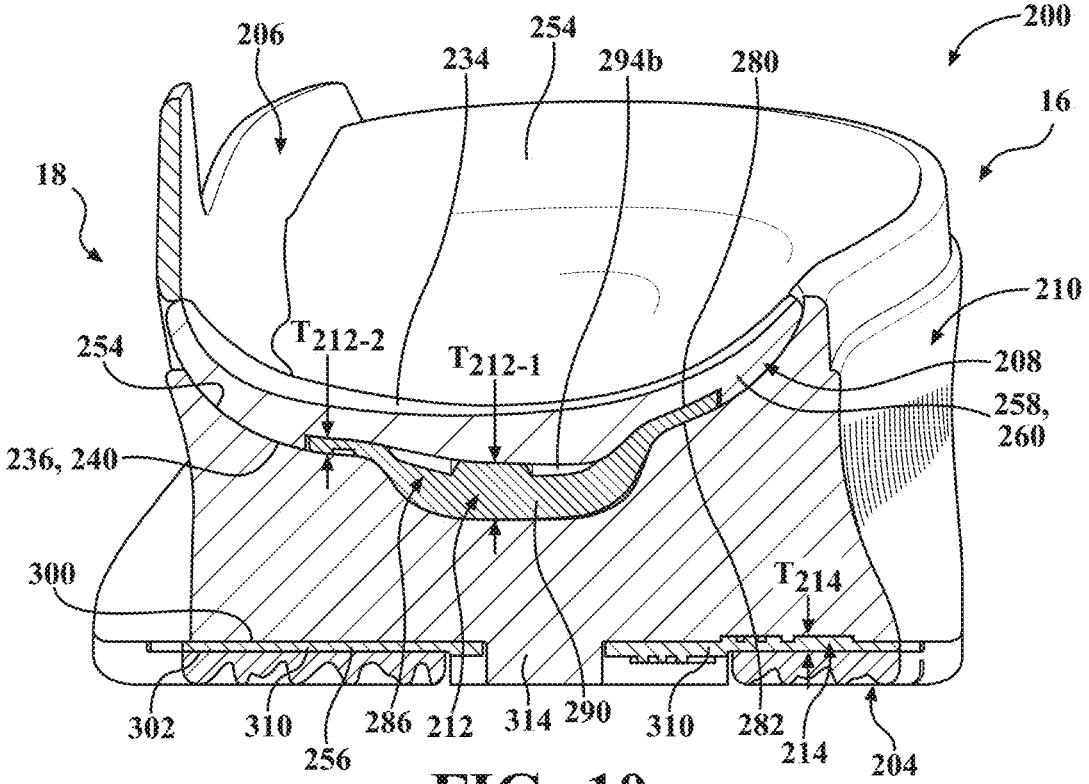
FIG. 10 is a cross-sectional view of the article of footwear of FIG. 1, taken along section line 10-10 of FIG. 7.

The shank 286 includes an elongate member continuously from the lobes 284 to the second end 278 of the upper plate 212. The bottom side 282 of the shank 286 includes a stiffening rib 290 extending along the length of the shank 286. As best shown in FIGS. 10 and 11, the stiffening rib 290 is formed by a central portion of the shank 286 having an increased thickness $T_{212-1}$ relative to a thickness $T_{212-2}$ along the outer periphery of the shank 286. Optionally, the top side 280 of the shank 286 further includes a platform 292 formed at the second end 278 of the upper plate 212. As best shown in FIG. 8, the platform 292 is defined by a portion of the top side 280 that is offset at the second end 278 to provide an increased thickness. The portion of the shank 286 including the platform 292 is received within the upper socket 258 of the heel cushioning element 210 such that the top side 280 of the platform 292 is exposed between the heel cushioning element 210 and the forefoot cushioning element 208 and defines a portion of the footbed of the sole structure 200.

The upper plate 212 may further include one or more lattice structures 294*a*-294*d* integrally formed in the top side 280 and/or the bottom side 282 of the upper plate 212. Each of the lattice structures 294*a*-294*d* is defined by a plurality of recesses formed in one of the top side 280 or the bottom side 282, such that the lattice structures 294*a*-294*d* are formed as substantially flush elements of the top side 280 and the bottom side 282. In the illustrated example, the upper plate 212 includes a first upper lattice structure 294*a* formed in the top side 280 of the upper plate 212 between the pair of the lobes 284 at the first end 276. The upper plate 212 includes a second upper lattice structure 294*b* formed in the top side 280 between the lobes 284 and the platform 292. A third upper lattice structure 294*c* is formed in the top side 280 along the platform 292. Here, each of the upper lattice structures 294*a*-294*c* is formed with an oblique orientation, such that rows and columns of the recesses defining the upper lattice structures 294*a*-294*c* are oriented at oblique angles relative to the longitudinal axis Aio of the footwear. Referring to FIG. 6, the bottom side 282 of the upper plate 212 includes a lower lattice structure 294*d* formed in the rib 290 between the lobes 284 and the platform 292. Unlike the upper lattice structures 294*a*-294*c*, which are oriented at an oblique angle, the lower lattice structure 294*d* is oriented such that rows of the recesses are aligned substantially parallel to the longitudinal axis Aio of the footwear. While the lattice structures 294*a*-294*d* of the illustrated example include grid-shaped lattice profiles (e.g., rectangular recesses), one or more of the lattice structures may include a honeycomb-shaped lattice profile (e.g., hexagonal recesses).

With continued reference to FIGS. 4-6 and 8-11, the lower plate 214 of the sole structure 200 extends from a first end 296 to a second end 298 and includes a top side 300 and a bottom side 302 formed on an opposite side from the top side 300. A distance from the top side 300 to the bottom side 302 defines a thickness $T_{214}$ (FIG. 10) of the lower plate 214. With reference to FIG. 1, when the sole structure 200 is assembled, the first end 296 of the lower plate 214 attaches to the bottom surface 238 of the forefoot cushioning element 208 and the second end 298 of the lower plate 214 attaches to the bottom side 302 of the heel cushioning element 210. The lower plate 214 includes an elastomeric material, such as a polyether block amide (PEBA) (e.g., Pebax® brand elastomers manufactured by Arkema S.A).

Referring to FIGS. 4-6, the lower plate 214 includes a tray 304 formed at the first end 296, a brace 306 formed at the second end 298, and a flexure rib 308 separating the tray 304 and the brace 306. The tray 304 is generally configured to interface with the bladders 218 of the cushioning arrangement 216. In the illustrated example, the tray 304 defines a substantially flat portion of the top side 300 of the lower plate 214 configured to attach to a lower portion of one of the bladders 218. However, in other examples, the tray 304 may include a profile defining lower sockets for receiving lower portions of the bladders 218.

The brace 306 of the lower plate 214 includes a pair of tabs 310 extending to independent distal ends 312 at the second end 298 of the lower plate 214. Here, the tabs 310 are separated from each other by a slot 314 extending along a central portion of the brace 306 through the second end 298. As shown in FIGS. 10 and 11, the tabs 310 of the brace 306 are independently attached to the bottom side 256 of the heel cushioning element 210 between the heel cushioning element 210 and the outsole 204. Thus, the distal end 312 of each tab 310 can move independent of the other distal end 312, providing the brace 306 with increased torsional flexibility while maintaining longitudinal stiffness along the length of the sole structure 200.

As shown in FIGS. 1 and 8, the lower plate 214 may be described as being bifurcated by the flexure rib 308 formed between the tray 304 and the brace 306. In other words, the flexure rib 308 provides a flexible joint extending across a width of the lower plate 214 to allow the tray 304 to articulate relative to the brace 306 during exercises that induce a bending force between the forefoot region 20 and the mid-foot region 22, such as burpees and mountain climbers. As shown in FIGS. 4-7, the flexure rib 308 extends across the width of the lower plate 214 along a path corresponding to a peripheral profile of a posterior end of the cushioning arrangement 216. Thus, similar to the flexure channel 244 formed in the forefoot cushioning element 208, the flexure rib 308 includes a pair of arcuate segments each complementing the convex curvature of one of the bladders 218.

The fluid cushioning arrangement 216 of the illustrated example includes a pair of bladders 218 each defining a respective chamber for including a pressurized fluid. A first one of the bladders 218 is disposed on the medial side 16 of the sole structure 200 in the forefoot region 20, and a second one of the bladders 218 is disposed on the lateral side 18 of the sole structure 200 in the forefoot region 20. Each the bladders 218 is received between one of the lobes 284 of the upper plate 212 and the tray 304 of the lower plate 214 such that a top surface of each bladder 218 is received within one of the sockets 288 on the bottom side 282 of the upper plate 212 and a bottom surface of each bladder 218 is attached to the top side 300 of the tray 304.

Each of the bladders 218 may include a first barrier element 320a and a second barrier element 320b formed of an elastomeric material. The chamber of each of the bladders 218 may receive a tensile element 322 (FIG. 9) therein. Each tensile element 322 may include a series of tensile strands 324 extending between an upper tensile sheet 326 and a lower tensile sheet 326. The upper tensile sheet 326 may be attached to the first barrier element 320a while the lower tensile sheet 326 may be attached to the second barrier element 320b. In this manner, when the bladder 218 receives the pressurized fluid, the tensile strands 324 of the tensile element 322 are placed in tension. Because the upper tensile sheet 326 is attached to the first barrier element 320a and the lower tensile sheet 326 is attached to the second barrier element 320b, the tensile strands 324 retain a desired shape of the bladder 218 when the pressurized fluid is injected into the chamber.

As used herein, the term "barrier element" (e.g., barrier elements 320*a*, 320*b*) encompasses both monolayer and multilayer films. In some embodiments, one or both of barrier elements 320*a*, 320*b* are produced (e.g., thermoformed or blow molded) from a monolayer film (a single layer). In other embodiments, one or both of the barrier elements 320*a*, 320*b* are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier elements 320*a*, 320*b* can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier elements 320*a*, 320*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'- dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof In an aspect, the thermoplastic TPU can include polyester-based TPU, polyether-based TPU, polycaprolactone-based TPU, polycarbonate-based TPU, polysiloxane-based TPU, or combinations thereof In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier elements 320*a*, 320*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier elements 320*a*, 320*b* include two or more sublayers, examples of suitable multilayer films include microlayer films, such as those disclosed in Bonk et al., U.S. Pat. No. 6,582,786, which is incorporated by reference in its entirety. In further embodiments, barrier elements 320*a*, 320*b* may each independently include alternating sublayers of one or more TPU copolymer materials and one or more EVOH copolymer materials, where the total number of sublayers in each of the barrier elements 320*a*, 320*b* includes at least four (4) sublayers, at least ten (10) sublayers, at least twenty (20) sublayers, at least forty (40) sublayers, and/or at least sixty (60) sublayers.

The bladders 218 can be produced from the barrier elements 320*a*, 320*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier elements 320*a*, 320*b* can be produced by co-extrusion followed by vacuum thermoforming to produce an inflatable bladder 218, which can optionally include one or more valves (e.g., one way valves) that allows the bladder 218 to be filled with the fluid (e.g., gas).

The bladder 218 can be provided in a fluid-filled (e.g., as provided in footwear 10) or in an unfilled state. The bladder 218 can be filled to include any suitable fluid, such as a gas or liquid. In an aspect, the gas can include air, nitrogen (N2), or any other suitable gas. In other aspects, the bladder 218 can alternatively include other media, such as pellets, beads, ground recycled material, and the like (e.g., foamed beads and/or rubber beads). The fluid provided to the bladder 218 can result in the bladder 218 being pressurized. Alternatively, the fluid provided to the bladder 218 can be at atmospheric pressure such that the bladder 218 is not pressurized but, rather, simply contains a volume of fluid at atmospheric pressure.

The fluid-filled bladder 218 desirably has a low gas transmission rate to preserve its retained gas pressure. In some embodiments, the fluid-filled bladder 218 has a gas transmission rate for nitrogen gas that is at least about ten (10) times lower than a nitrogen gas transmission rate for a butyl rubber layer of substantially the same dimensions. In an aspect, fluid-filled bladder 218 has a nitrogen gas transmission rate of 15 cubic-centimeter/square-meteratmosphereday ($cm^3/m^2$•atm•day) or less for an average film thickness of 500 micrometers (based on thicknesses of the barrier layers 218*a*, 218*b*). In further aspects, the transmission rate is 10 $cm^3/m^2$•atm•day or less, 5 $cm^3/m^2$•atm•day or less, or 1 $cm^3/m^2$•atm•day or less.

As discussed previously, the lateral support member 206 is attached to the midsole 202 and is configured to support lateral (e.g., side-to-side) forces along the lateral side 18 of the upper 100 in the heel region 24. The lateral support member 206 includes materials having a greater stiffness than the materials of the heel cushioning element 210, such as a TPU material. The lateral support member 206 extends from a first end 340 in the mid-foot region 22 to a second end 342 at the posterior end 14. Here, the first end 340 is aligned with the first end 250 of the heel cushioning element 210. The lateral support member 206 includes an inner surface 344 configured to face the upper 100 and an outer surface 346 formed on an opposite side from the inner surface 344. When the sole structure 200 is assembled, the lateral support member 206 mates with the lateral support socket 272 formed along the lateral side 18 of the heel cushioning element 210 such that the inner surface 344 is flush and continuous with the top side 254 of the heel cushioning element 210 and forms a portion of the footbed of the sole structure 200.

The lateral support member 206 includes a vertical leg 348 formed at the first end 340 of the lateral support member 206 and a longitudinal leg 350 extending from the vertical leg 348 to the second end 342. As shown, the vertical leg 348 has a greater height H348 from the top side 254 of the heel cushioning element 210 than the height $H_{350}$ of the longitudinal leg 350 such that the vertical leg 348 is configured to provide increased lateral support along the mid-foot region 22 of the upper 100. In the illustrated example, a distal end of the vertical leg 348 is vertically aligned (i.e., same distance from the longitudinal axis Aio) with an apex of the lateral stability member 246.

With continued reference to FIGS. 4-6, the anterior fragment 220 of the outsole 204 is formed of a resilient elastomeric material and is disposed at the anterior end 12 of the sole structure 200. The posterior fragment 222 extends from the flexure channel 244 to the posterior end 14 of the sole structure 200. The posterior fragment 222 includes an opening 330 formed through a thickness of the posterior fragment 222 to expose the bottom side 302 of the lower plate 214 and the bottom side 256 of the heel cushioning element 210. The posterior fragment 222 further includes a flexure rib 332 that mates with flexure rib 308 of the lower plate 214.

The following Clauses provide exemplary configurations for a sole structure and an article of footwear described herein.

Clause 1. A sole structure for an article of footwear, the sole structure comprising a first cushioning element including a first top side and a bottom side formed on an opposite side from the first top side and defining a receptacle, a second cushioning element attached to the first cushioning element and including a second top side flush with the first top side of the first cushioning element, at least one plate extending along the receptacle and including one end attached to the first cushioning element and another end attached to the second cushioning element, and a cushioning arrangement disposed within the receptacle of the first cushioning element and attached to the at least one plate.

Clause 2. The sole structure of Clause 1, wherein the at least one plate includes an upper plate having a first end attached to the bottom side of the first cushioning element and a second end attached to the second top side of the second cushioning element.

Clause 3. The sole structure of Clause 2, wherein the upper plate, the first cushioning element, and the second cushioning element each define a portion of a footbed of the sole structure.

Clause 4. The sole structure of Clause 2 or 3, wherein the upper plate includes a rib extending between the first end of the upper plate and the second end of the upper plate.

Clause 5. The sole structure of any of the preceding Clauses, wherein the at least one plate includes a lower plate including a third end attached to the bottom side of the first cushioning element and a fourth end attached to a bottom side of the second cushioning element.

Clause 6. The sole structure of Clause 5, wherein the lower plate includes a flexure rib formed between the third end of the lower plate and the fourth end of the lower plate.

Clause 7. The sole structure of Clause 6, wherein the cushioning arrangement is attached to the lower plate between the flexure rib and the third end of the lower plate.

Clause 8. The sole structure of any of the preceding Clauses, further comprising a lateral support member attached to the second top side of the second cushioning element.

Clause 9. The sole structure of Clause 8, wherein the lateral support member includes a vertical leg disposed in a mid-foot region of the sole structure and a longitudinal leg extending along a heel region of the sole structure.

Clause 10. The sole structure of Clause 9, wherein a distal end of the vertical leg is aligned with an apex of the first cushioning element.

Clause 11. A sole structure for an article of footwear, the sole structure comprising a first cushioning element including a first top side and a bottom side formed on an opposite side from the first top side and defining a receptacle, a second cushioning element attached to the first cushioning element and including a second top side flush with the first top side of the first cushioning element, an upper plate disposed within the receptacle and including a first end attached to the first cushioning element and a second end attached to the second cushioning element, a lower plate spaced apart from the upper plate and including a third end attached to the first cushioning element and a fourth end attached to the second cushioning element, and a cushioning arrangement disposed within the receptacle of the first cushioning element and attached to each of the upper plate and the lower plate.

Clause 12. The sole structure of Clause 11, wherein the first end of the upper plate is attached to the bottom side of the first cushioning element in the receptacle and the second end of the upper plate is attached to the second top side of the second cushioning element.

Clause 13. The sole structure of Clause 12, wherein the upper plate, the first cushioning element, and the second cushioning element each define a portion of a footbed of the sole structure.

Clause 14. The sole structure of Clause 12 or 13, wherein the upper plate includes a rib extending between the first end of the upper plate and the second end of the upper plate.

Clause 15. The sole structure of any of the preceding Clauses, wherein the third end of the lower plate is attached to the bottom side of the first cushioning element and the fourth end is attached to a bottom side of the second cushioning element.

Clause 16. The sole structure of Clause 15, wherein the lower plate includes a flexure rib formed between the third end of the lower plate and the fourth end of the lower plate.

Clause 17. The sole structure of Clause 16, wherein the cushioning arrangement is attached to the lower plate between the flexure rib and the third end of the lower plate.

Clause 18. The sole structure of any of the preceding Clauses, further comprising a lateral support member attached to the second top side of the second cushioning element.

Clause 19. The sole structure of Clause 18, wherein the lateral support member includes a vertical leg disposed in a mid-foot region of the sole structure and a longitudinal leg extending along a heel region of the sole structure.

Clause 20. The sole structure of Clause 19, wherein a distal end of the vertical leg is aligned with an apex of the first cushioning element.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a first cushioning element including a first top side and a bottom side formed on an opposite side from the first top side and a first end and a second end opposing the first end and defining a receptacle;

a second cushioning element attached to the first cushioning element, including a second top side flush with the first top side of the first cushioning element, and including an upper socket, the second end of the first cushioning element being received in the upper socket;

at least one plate extending along the receptacle and including one end attached to the first cushioning element and another end attached to the upper socket of the second cushioning element, a top side of the at least one plate being flush with the first top side of the first cushioning element; and a cushioning arrangement disposed within the receptacle of the first cushioning element and attached to the at least one plate.

2. The sole structure of claim 1, wherein the at least one plate includes an upper plate having a first end attached to the bottom side of the first cushioning element and a second end attached to the second top side of the second cushioning element.

3. The sole structure of claim 2, wherein the upper plate, the first cushioning element, and the second cushioning element each define a portion of a footbed of the sole structure.

4. The sole structure of claim 2, wherein the upper plate includes a rib extending between the first end of the upper plate and the second end of the upper plate.

5. The sole structure of claim 1, wherein the at least one plate includes a lower plate including a third end attached to the bottom side of the first cushioning element and a fourth end attached to a bottom side of the second cushioning element.

6. The sole structure of claim 5, wherein the lower plate includes a flexure rib formed between the third end of the lower plate and the fourth end of the lower plate.

7. The sole structure of claim 6, wherein the cushioning arrangement is attached to the lower plate between the flexure rib and the third end of the lower plate.

8. The sole structure of claim 1, further comprising a lateral support member attached to the second top side of the second cushioning element.

9. The sole structure of claim 8, wherein the lateral support member includes a vertical leg disposed in a mid-foot region of the sole structure and a longitudinal leg extending along a heel region of the sole structure.

10. The sole structure of claim 9, wherein a distal end of the vertical leg is aligned with an apex of the first cushioning element.

11. A sole structure for an article of footwear, the sole structure comprising:

a first cushioning element including a first top side and a bottom side formed on an opposite side from the first top side and a first end and a second end opposing the first end and defining a receptacle;

a second cushioning element attached to the first cushioning element and including a second top side flush with the first top side of the first cushioning element and an upper socket receiving the second end of the first cushioning element;

an upper plate disposed within the receptacle and including a first end attached to the first cushioning element and a second end attached to the upper socket of the second cushioning element, a top side of the upper plate being flush with the first top side of the first cushioning element;

a lower plate spaced apart from the upper plate and including a third end attached to the first cushioning element and a fourth end attached to the second cushioning element; and a cushioning arrangement disposed within the receptacle of the first cushioning element and attached to each of the upper plate and the lower plate.

12. The sole structure of claim 11, wherein the first end of the upper plate is attached to the bottom side of the first cushioning element in the receptacle and the second end of the upper plate is attached to the second top side of the second cushioning element.

13. The sole structure of claim 12, wherein the upper plate, the first cushioning element, and the second cushioning element each define a portion of a footbed of the sole structure.

14. The sole structure of claim 12, wherein the upper plate includes a rib extending between the first end of the upper plate and the second end of the upper plate.

15. The sole structure of claim 11, wherein the third end of the lower plate is attached to the bottom side of the first cushioning element and the fourth end is attached to a bottom side of the second cushioning element.

16. The sole structure of claim 15, wherein the lower plate includes a flexure rib formed between the third end of the lower plate and the fourth end of the lower plate.

17. The sole structure of claim 16, wherein the cushioning arrangement is attached to the lower plate between the flexure rib and the third end of the lower plate.

18. The sole structure of claim 11, further comprising a lateral support member attached to the second top side of the second cushioning element.

19. The sole structure of claim 18, wherein the lateral support member includes a vertical leg disposed in a mid-foot region of the sole structure and a longitudinal leg extending along a heel region of the sole structure.

20. The sole structure of claim 19, wherein a distal end of the vertical leg is aligned with an apex of the first cushioning element.

* * * * *